United States Patent [19]

Spector

[11] 4,266,369

[45] May 12, 1981

[54] TOY CABLEWAY

[76] Inventor: Donald Spector, 380 Mountain Rd., Union City, N.J. 07087

[21] Appl. No.: 37,047

[22] Filed: May 8, 1979

[51] Int. Cl.[3] ..... A63H 18/12

[52] U.S. Cl. ..... 46/260; 46/1 H; 272/31 R

[58] Field of Search ..... 46/253, 254, 257, 1 H, 46/122, 29, 260, 74 R; 104/93, 180; 272/31 R

[56] References Cited

U.S. PATENT DOCUMENTS

| | | | |
|---|---|---|---|
| 1,674,293 | 6/1928 | Marx | 272/31 RX |
| 1,817,775 | 8/1931 | Sipe | 46/29 X |
| 2,492,319 | 12/1949 | Rendine | 46/122 |
| 2,900,496 | 8/1959 | Williams | 46/29 X |
| 2,913,997 | 11/1959 | Wolf | 104/93 |
| 2,941,332 | 6/1960 | Tracy | 46/253 X |
| 3,345,095 | 10/1967 | Hohenberger | 46/29 X |

FOREIGN PATENT DOCUMENTS

| | | | |
|---|---|---|---|
| 304420 | 1/1955 | Switzerland | 46/122 |

*Primary Examiner*—Robert Peshock
*Assistant Examiner*—Mickey Yu
*Attorney, Agent, or Firm*—Michael Ebert

[57] ABSTRACT

A toy cableway assembly in which an endless cable is strung over pulley wheels which are rotatable on standards that are detachably mounted on a vertical wall. The standards project laterally from the wall at selected sites therein to determine the travel pattern of the cable which rides in a plane parallel to the wall surface. One pulley is manually or otherwise driven, the others being idlers, whereby cars or other toy elements suspended from the cable at spaced points thereon are caused to travel in the pattern established by the player. In practice, the travel pattern may be extended to include the ceiling.

9 Claims, 7 Drawing Figures

18

26
25
11B
23
24
19
22
20

11B
32
27
11A
30

29B
28B
27
28
28A
29A
11A 30
31

TOY CABLEWAY

BACKGROUND OF INVENTION

This invention relates generally to toy cableways and more particularly to a cableway which is mountable against a vertical wall in any desired geometric travel pattern whereby the cars or other toy elements suspended from the driven cable travel in a circuitous path in a plane parallel to the wall surface.

Toy railroads have been popular with children for almost as many years as full scale railroads have been in existence. Such toys are available commercially in a broad range of designs going from relatively simple and inexpensive set-ups to highly elaborate and costly arrangements.

But regardless of their degree of complexity, all toy railways include a trackway usually made up of assembled track sections, some of which are straight and others curved, the trackway being set up on the floor or on a large table in a desired pattern. The train which rides on the trackway is usually composed of a locomotive and one or more cars coupled thereto.

The principal drawback, in practical terms, of existing forms of toy railroads resides in their space requirements. If the toy railroad consists, say, of a simple oval trackway whose long dimension is three feet, then this represents no great problem. But few children are satisfied with so elementary a trackway, for the play possibilities thereof are quickly exhausted.

Hence, the modern tendency is toward larger and more elaborate trackways, some of which occupy almost all of the available floor space in a playroom or wherever else the system is erected. Since a system of this design allows little space for any other play activity, it is generally necessary, after a few hours of play, to dismantle the entire railroad and store it until one again wishes to play, at which time the system must be reassembled.

Apart from these difficulties, a toy railroad installed on the floor of a playroom represents a potential hazard, for it may occupy most of the floor area, and anyone who enters the room is in danger of tripping over the trackway and its associated equipment or of colliding with the train running thereover. And while this factor may not diminish the popularity of such railroads with children, parents are not likely to share their offspring's enthusiasm and may justifiably regard existing toy railroads as a household nuisance.

SUMMARY OF INVENTION

In view of the foregoing, the main object of this invention is to provide a toy cableway system which is mountable against a vertical wall in a selected geometric travel pattern whereby cars or other play elements suspended from the driven cable travel in a circuitous path in a plane parallel to the wall. The travel pattern may be extended to include the ceiling.

By definition, a cable railroad is one in which the cars grip and are moved by an endless cable that is sometimes laid underground, such as the classic trolley-car system in San Francisco. When the endless cable is supported by elevated standards to constitute an overhead track for the cars, it is known as a cableway.

The distinctions between a cableway in accordance with the invention and a conventional cableway is that the standards for supporting the cable are not anchored in the ground plane but project laterally from a vertical wall.

A significant advantage of this invention is that it exploits an otherwise unused wall area as a play space and leaves the floor space free for other purposes. Hence, even if the toy is left on the wall after a play period, it does not represent an obstacle or hazard in the room.

More particularly, an object of this invention is to provide a cableway in which the standards for supporting the cable are detachably mounted on a vertical wall, the standards having a pressure-sensitive adhesive base making it possible to place the standards at desired sites on the wall and to change these sites at will to create any desired travel pattern.

Also an object of the invention is to provide an endless cable for a cableway in the form of elastomeric tubing whose ends are joined together by double-ended flexible plug connectors, each plug of which is insertable in the associated end of the cable.

A significant feature of a plug connector in accordance with the invention is that it facilitates the coupling of cars and other elements to the cable by means of a removable clip which clamps onto the connector, so that the play element may be readily replaced.

Also an object of this invention is to provide a stable standard having a pulley wheel rotatably mounted thereon for supporting the endless cable of the cableway, which standard has a pedestal from which an array of outriggers extend, the outriggers terminating in feet which engage the wall to resist bending moments.

Briefly stated, these objects are attained in a toy cableway system in which an endless cable is strung over pulley wheels which are rotatable on standards that are detachably mounted on a vertical wall, the standards projecting laterally from the wall at selected sites thereon which determine the travel pattern of the cable riding in a plane parallel to the wall surface.

One of the pulleys in cableway systems is manually or otherwise driven, the others being idlers whereby cars or other toy elements suspended from the cable at spaced points thereon are caused to travel in the pattern established by the player.

OUTLINE OF DRAWINGS

For a better understanding of the invention as well as other objects and further features thereof, reference is made to the following detailed description to be read in conjunction with the accompanying drawing, wherein.

Figures 2, 3, 4, 5, 6:
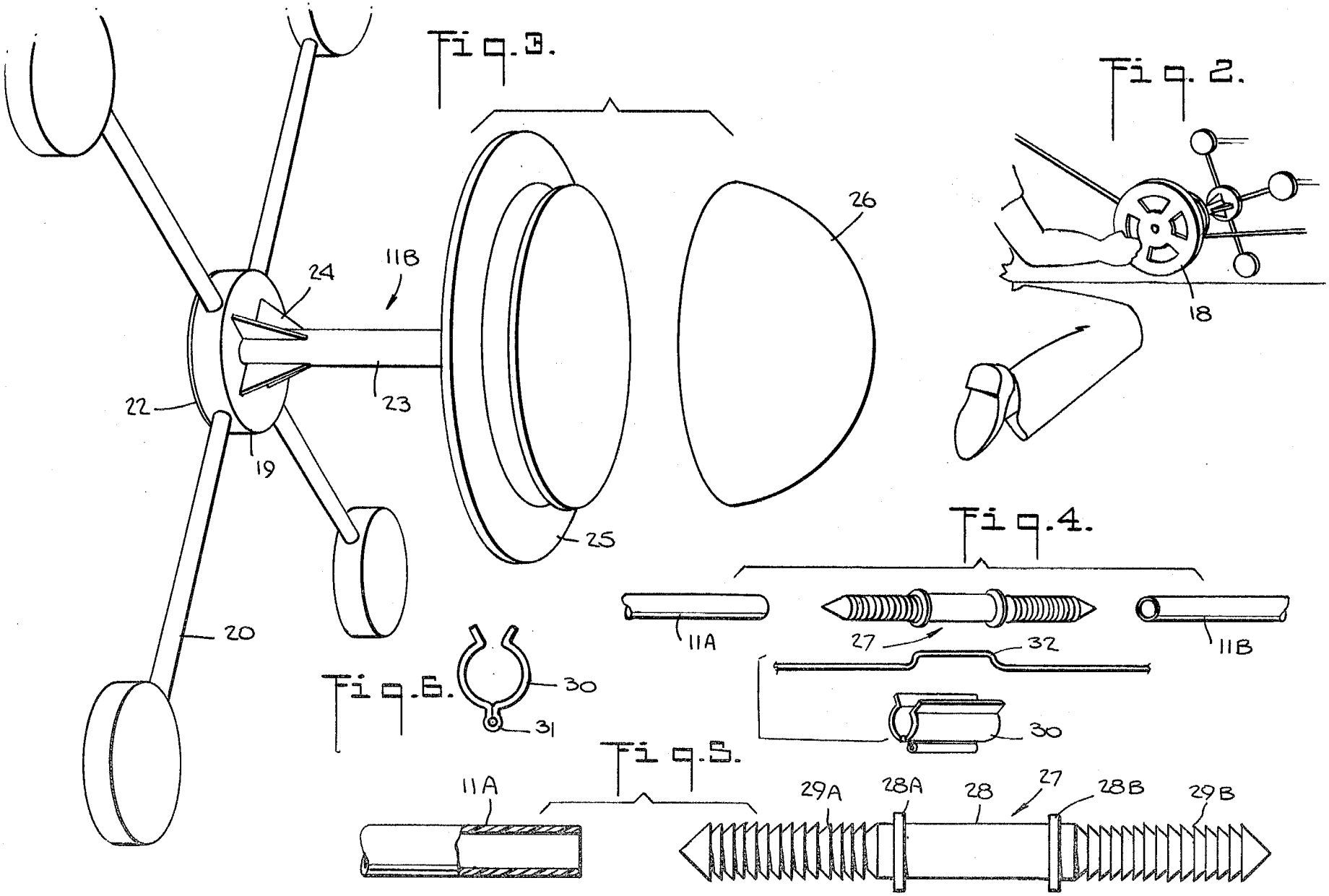
FIG. 2 shows a manually-operated cableway.

FIG. 3, in perspective, illustrates one of the standards included in the system;

FIG. 4 shows, in perspective, the elements of the double-ended plug connector for the cable and the clip associated therewith;

FIG. 5 shows in section the relationship between one end of the cable and the plug connector;

FIG. 6 is an end view of the clip; and

Figure 7:
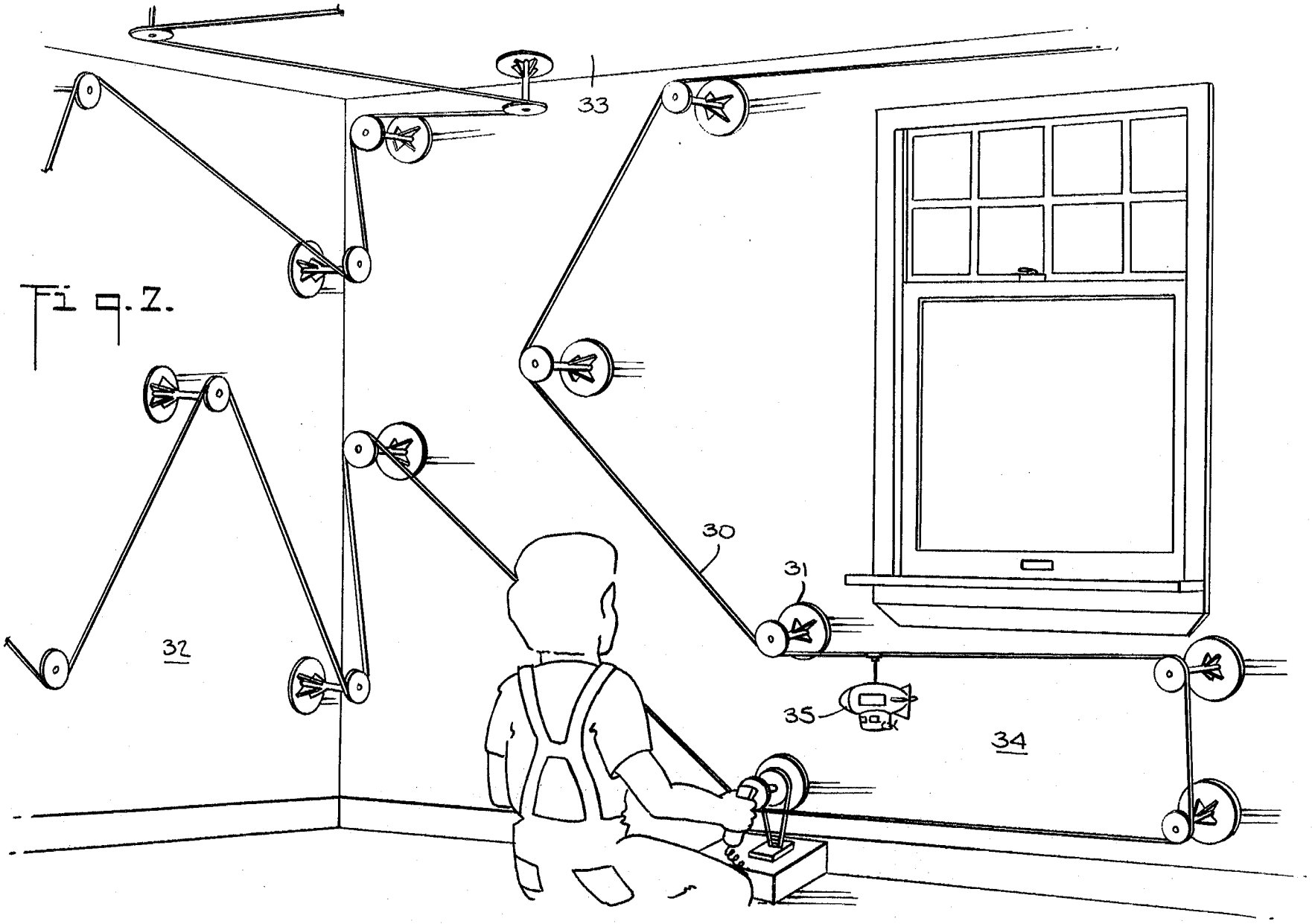

FIG. 7 shows another embodiment of the cableway.

DESCRIPTION OF INVENTION

Figure 1:
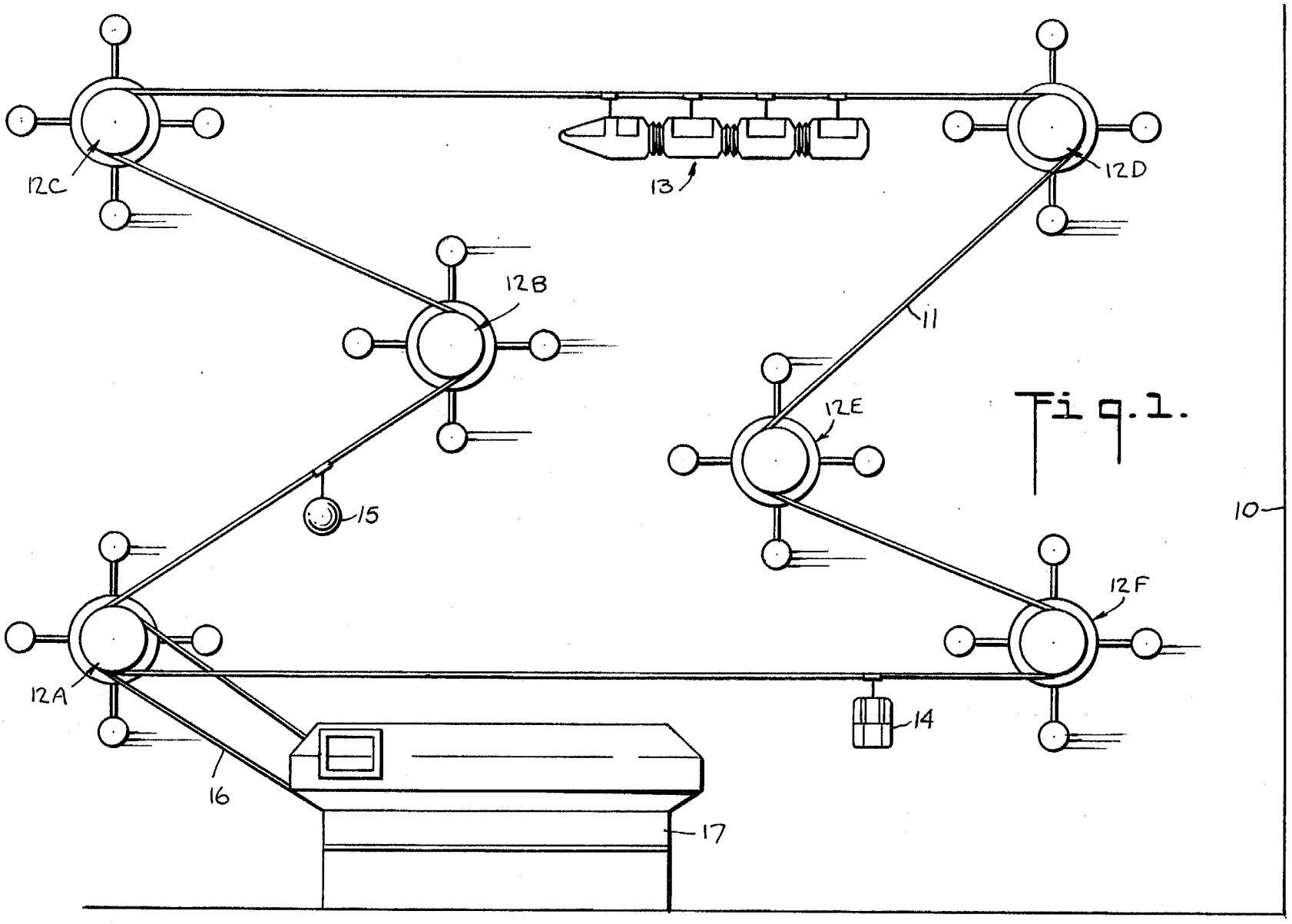
FIG. 1 is an elevation view showing a toy cableway system in accordance with the invention, the cableway being motorized.

Referring now to FIG. 1, there is shown a preferred embodiment of a toy cableway system in accordance with the invention, the system being installed on a vertical wall 10. The system is composed of an endless cable 11 and a plurality of standards generally designated by numeral 12. In the example illustrated, six standards 12A to 12F are provided. In practice, the system may include smaller or greater number of such standards which are attached to the wall at selected sites thereon to create a desired geometric travel pattern for the cable. Instead of directly anchoring the standards in the wall, one may first adhere to the wall a contoured sheet of flexible plastic material whose profile affords the outline of the system to be erected. The sheet containing art work to provide an attractive or appropriate environment for the system erected thereon.

Each standard 12 projects laterally from the wall and has a pulley wheel rotatably mounted thereon. Cable 11 is strung over the wheels of the pulleys so that when any of the wheels is driven, the cable then rides on the pulleys in the travel pattern established by the player. Suspended from cable 11 at different points therealong is a train of rocket-shaped cars 13, a cable car 14 and a ball 15. These play elements are shown merely as samples of what may be attached to the cable.

The pulley wheel on standard 12A acts in the arrangement shown in FIG. 1 as the drive pulley. For this purpose, the pulley is of the double-wheel type; one wheel acting to support cable 11 and the parallel wheel having an endless belt 16 looped thereover to link the pulley to an electrically-powered control assembly 17. Assembly 17 includes a small motor, and on-off switch and a speed control mechanism whose form depends on the power source. Thus if the motor is battery-operated, a potentiometer may be used to vary the battery voltage applied to the motor to adjust its operating speed. Where the motor is a-c operated from a wall socket, a multi-tap transformer may be used for the same purpose.

Control Assembly 17 is weighted so that it can be shifted on the floor at a position adjacent to the drive pulley on standard 12A to a point applying a proper degree of tension on belt 16. All other pulleys in the system then function as idler wheels.

Thus when the motor is operated, the cable driven thereby runs over the pulleys and carries with it the play elements suspended therebelow by one or more flexible wires which, when the cable passes over and around a pulley wheel, also pass thereover. The pulley wheels are adequately spaced from the wall to prevent interference with the three-dimensional play elements.

The system need not be electrically powered; for, as shown in FIG. 2, the drive pulley may have a crank wheel 18 keyed thereto whose handle is manually turned by the player who can thereby run the cable at any desired speed.

The structure of a standard 12 is illustrated in FIG. 3, where it will be seen that the standard includes a round pedestal 19 from which radially extends an array of outriggers 20, each terminating in a circular foot 21 that engages the wall. These outriggers serve to resist bending moments that would otherwise tend to dislodge the pedestal from the wall.

The base of pedestal 19 is provided with a pad of pressure-sensitive adhesive material, making it possible to press the pedestal against the wall at any chosen site and to anchor the standard thereon. In practice, this circular pad may be in the form of a double-faced adhesive tape, one face of which is adhered to the base of the pedestal and the other to the wall surface, the outer face being covered by a protective liner that is not peeled off until one is ready to attach the standard to the wall.

Projecting from pedestal 19 is a shaft 23 whose position on the pedestal is stabilized by reinforcing fins 24. A flanged pulley wheel 25 is rotatably mounted on the free end of the shaft. In practice, the outer face of the pulley wheel may be designed to accommodate a snap-on decorative cover 26 which is illustrated as dome-shaped.

This cover may have well-known comic strip or other figures or characters printed thereon, this being determined by the nature of the play element suspended from the cable. Thus, when the elements are rocket ships and the play theme is travel in space, the covers of the pulleys may be representations of planets.

The vertical travel pattern created on the wall is determined by the player who decides where to anchor the standards. For an endless cable of fixed length, the sites must be within the limits defined by the cable loop. Use, however, is preferably made of a cable of elastomeric material to afford some leeway in this regard. Also by means of connectors of the type disclosed hereinafter, one may effectively splice in cable sections of different length to expand the loop dimensions.

Referring now to FIGS. 4 and 5, it will be seen that cable 11 is formed of rubber tubing or other hollow elastomeric material, the cable ends ends 11A and 11B being joined together by a connector 27 which is fabricated of resilient plastic material. Connector 27 is constituted by a cylindrical section 28 having flanges 28A and 28B at either end thereof. Projecting axially from one end of section 28 is a plug 29A which is adapted to be inserted in cable end 11A, and projecting axially from the other end of section 28 is a like plug 29B which is adapted to be received in cable end 11B, the ends serving as sockets for the plugs.

Each plug is formed by a series of annular teeth each having its truncated conical formation except for the end tooth which is in the form of a conical head. Thus when the plug is forcibly inserted in a cable end, the teeth are compressed and resist withdrawal of the plug. The teeth are deep enough to allow the connector plug to bend around the pulley wheel.

To attach a play element to the cable at its point of connection, a plastic clip 30 is provided. This clip is constituted by a complementary pair of semi-cylindrical jaws which are held together by a living hinge and fit about the connector section.

The hinge formation is such as to provide a longitudinal bore 31 which receives the midsection of a wire 32, the bendable end portions of the wire being connected to the play element to be suspended from the cable.

In practice, therefore, the cable may be in the form of sections in various lengths which can be joined together by connectors, from each of which a play element is suspended. The number of section lengths chosen by the player to be interconnected determines the overall loop dimension of the endless cable.

As shown in FIG. 7, the cableway need not be limited to a single vertical wall, but can be erected to exploit adjacent wall and ceiling areas as well. Thus cable 30 strung on pulley standards 31 is set up to travel on vertical wall 32, from there to ceiling 33, and from the ceiling to the adjacent vertical wall 34.

It will be seen that a bomb-like car 35 is borne by the cable. In practice, this cable-drawn car may be arranged with a normally-closed bomb hatch that is actuated when the car passes an abutment placed in the cable path on the ceiling. The hatch, when opened, releases toy bombs or elements which are associated with small parachutes that are caused to open when released from the hatch, so that these elements descend slowly rather than drop abruptly to the ground.

While there has been shown and described a preferred embodiment of a toy cableway in accordance with the invention, it will be appreciated that many changes and modifications may be made therein without, however, departing from the essential spirit thereof.

I claim:

1. A detachable toy cableway system comprising:

A. a plurality of standards which are attachable to a vertical wall at selected sites thereon to create any one of several different travel patterns, each standard having a pedestal whose base is provided with adhesive to anchor the standard at a wall site selected therefor and a pulley wheel rotatably mounted at the end of a shaft projecting outwardly from the pedestal at right angles to the wall;

B. an endless cable of stretchable material strung over the pulley wheels to provide an expandable cable length which can be accommodated to any one of the different travel patterns, one of the wheels being driven to cause said cable to advance in a path determined by the selected travel pattern; and C. play elements suspended from said cable at various points thereon.

2. A system as set forth in claim 1, wherein said pedestal is provided with outriggers to stabilize its position in the wall.

3. A system as set forth in claim 1, further including an electrically-operated motor control assembly linked by a belt to said driven wheel.

4. A system as set forth in claim 1, wherein said cable is formed by tubing of elastomeric material whose ends are joined together by a connector of resilient material from which one of said play elements is suspended.

5. A system as set forth in claim 4, wherein said connector is formed by a cylindrical section having plugs extending from either end for insertion in the associated end of the tubing.

6. A system as set forth in claim 5, wherein each plug is formed by a series of annular teeth which are compressed in said tubing.

7. A system as set forth in claim 5, further including a clip formed by a pair of complementary half-pieces which are hinged together and conform to said section, said clip serving to suspend the play element from said cable.

8. A system as set forth in claim 7, wherein said pieces are held together by a hinge having a longitudinal bore therein to accommodate a wire for suspending the play element.

9. A system as set forth in claim 1, wherein said pattern is extended to a ceiling adjacent said vertical wall.

* * * * *